US010538115B2

(12) United States Patent
Johnson et al.

(10) Patent No.: US 10,538,115 B2
(45) **Date of Patent: *Jan. 21, 2020**

(54) HANDLE OF A PRINTHEAD MOVABLE BETWEEN A FOLDED POSITION AND A NON-FOLDED POSITION

(71) Applicant: HEWLETT-PACKARD DEVELOPMENT COMPANY, L.P., Houston, TX (US)

(72) Inventors: Timothy Michael Johnson, Corvallis, OR (US); Daniel Gonzalez Perello, Terrassa (ES)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/936,985

(22) Filed: Mar. 27, 2018

(65) Prior Publication Data

US 2018/0215182 A1 Aug. 2, 2018

Related U.S. Application Data

(63) Continuation of application No. 15/311,756, filed as application No. PCT/US2014/040049 on May 29, 2014, now Pat. No. 9,962,973.

(51) Int. Cl.
*B41J 29/06* (2006.01)

(52) U.S. Cl.
CPC ..... *B41J 29/06* (2013.01)

(58) Field of Classification Search
None
See application file for complete search history.

(56) References Cited

U.S. PATENT DOCUMENTS

| | | | | |
|---|---|---|---|---|
| 6,070,975 | A | 6/2000 | Uchikata et al. | |
| 6,082,854 | A | 7/2000 | Axtell et al. | |
| 6,364,458 | B2 | 4/2002 | Eckard et al. | |
| 6,386,681 | B1 * | 5/2002 | Askren | B41J 2/17503 347/49 |
| 6,733,112 | B2 | 5/2004 | Scheffelin et al. | |
| 6,755,516 | B2 | 6/2004 | Hanson et al. | |

(Continued)

FOREIGN PATENT DOCUMENTS

| | | |
|---|---|---|
| CN | 1772488 | 5/2006 |
| KR | 20-0135374 | 5/1999 |

OTHER PUBLICATIONS

"Lift the Printhead Latch"; http://h10025.www1.hp.com/ewfrf/wc/document?cc=us&lc=en&docname=c01817398.

(Continued)

*Primary Examiner* — Erica S Lin
(74) *Attorney, Agent, or Firm* — HP Inc. Patent Department

(57) ABSTRACT

A printhead includes a printhead housing and a handle. The handle is movably coupled to the printhead housing. The handle rotatably moves with respect to the printhead housing between a folded position and the non-folded position. In the folded position, the handle extends along a respective housing surface of the printhead housing. In the non-folded position, the handle extends outward from the respective housing surface of the printhead housing.

19 Claims, 11 Drawing Sheets

(56) References Cited

U.S. PATENT DOCUMENTS

| | | | | |
|---|---|---|---|---|
| 6,916,088 | B2 | 7/2005 | Smith et al. | |
| 7,321,739 | B1 * | 1/2008 | Dawson | G03G 21/1846 222/DIG. 1 |
| 7,845,779 | B2 | 12/2010 | Nip | |
| 7,887,156 | B2 | 2/2011 | Middleton et al. | |
| 2002/0163566 | A1 | 11/2002 | Jang et al. | |
| 2009/0073223 | A1 | 3/2009 | Lim | |
| 2009/0278883 | A1 | 11/2009 | Rawlings | |
| 2010/0091068 | A1 | 4/2010 | McFadden et al. | |
| 2012/0030389 | A1 | 2/2012 | Ishikawa | |
| 2012/0050389 | A1 | 3/2012 | Inada et al. | |

OTHER PUBLICATIONS

"Raise the Print Head Lock Lever, and Then Lift the Print Head Out"; http://www.justanswer.com/printers/5rlwx-canon-ip4600-color-printer-just-installed-black-ink-221gy.html.

* cited by examiner

HANDLE OF A PRINTHEAD MOVABLE BETWEEN A FOLDED POSITION AND A NON-FOLDED POSITION

BACKGROUND

Printers include removable printheads to print images on substrates. The removable printheads are removably inserted into the printers. Periodically, the removable printheads are removed from the printers and replaced by new removable printheads.

BRIEF DESCRIPTION OF THE DRAWINGS

Non-limiting examples are described in the following description, read with reference to the figures attached hereto and do not limit the scope of the claims. Dimensions of components and features illustrated in the figures are chosen primarily for convenience and clarity of presentation and are not necessarily to scale. Referring to the attached figures:

DETAILED DESCRIPTION

Printheads may be used in printers to print images on substrates. Periodically, the printheads in the printers may need to be replaced. At times, however, accessing and/or removing the printheads may be difficult. For example, the respective printheads may be removably installed into a recessed compartment of the printer. The recessed area may cause limitations for a user to view the compartment to receive the printhead and/or the printhead. Accordingly, accessibility to grab and remove the printheads that are inserted in the printers may be limited. Thus, the removal of printheads from the printers may be difficult and time consuming.

In examples, a printhead includes a printhead housing and a handle. The handle is movably coupled to the printhead housing. The handle rotatably moves with respect to the printhead housing between a folded position and a non-folded position. In the folded position, the handle extends along a respective housing surface of the printhead housing. In the non-folded position, the handle extends outward from the respective housing surface of the printhead housing. In the non-folded position, the handle is configured to be accessed by a user to removably move the printhead housing into and out of a printer. Thus, the difficulty and amount of time to remove printheads from printers may be reduced.

Figure 1:
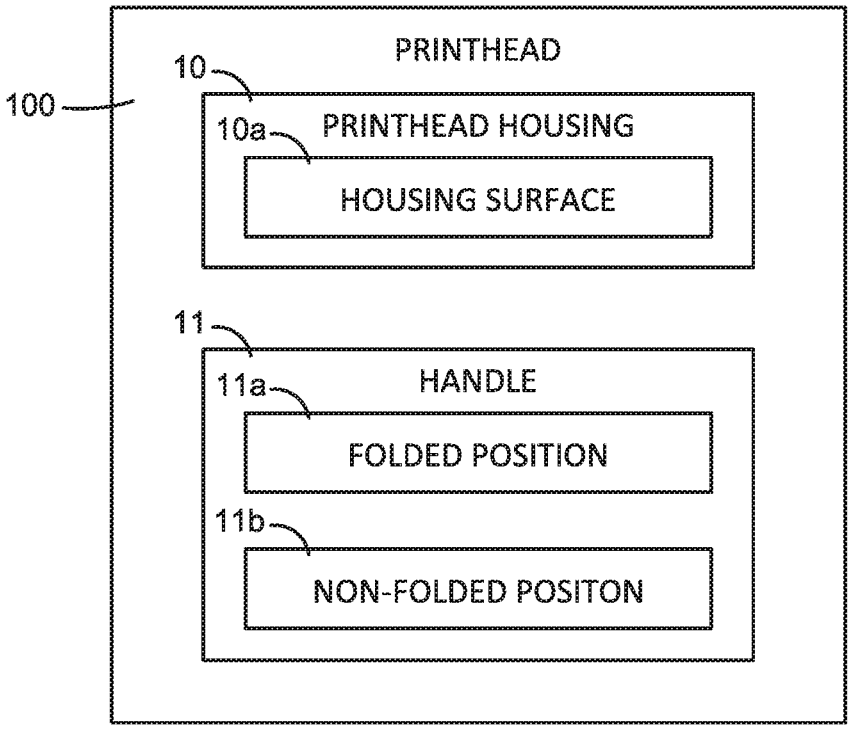
FIG. 1 is a block diagram illustrating a printhead according to an example.

FIG. 1 is a block diagram illustrating a printhead according to an example. Referring to FIG. 1, in some examples, a printhead 100 includes a printhead housing 10 and a handle 11. The handle 11 is movably coupled to the printhead housing 10. The handle 11 rotatably moves with respect to the printhead housing 10 between a folded position 11*a* and a non-folded position 11*b*. In the folded position 11*a*, the handle 11 extends along a respective housing surface 10*a* of the printhead housing 10. For example, the housing surface 10*a* may be a top or bottom surface of the printhead housing 10.

In some examples, in the folded position 11*a*, the handle 11 may be substantially parallel to the respective housing surface 10*a*. In some examples, the handle 11 may not extend above the respective housing surface 10*a*. In the folded position 11*a*, the printhead 100 including the handle 11 may be positioned such that the printhead 100 may not be inadvertently removed from the printer. In the non-folded position 11*b*, the handle 11 extends outward from the respective housing surface 10*a* of the printhead housing 10. Also, in the folded position 10*a*, an area needed to contain the printhead 100 may be reduced. In the non-folded position 11*b*, the handle 11 is configured to be accessed by a user to removably move the printhead housing 10 into and out of a printer. The handle 11 may also provide tactile feedback to the user. In some examples, the handle 11 may be U-shaped.

Figure 2:
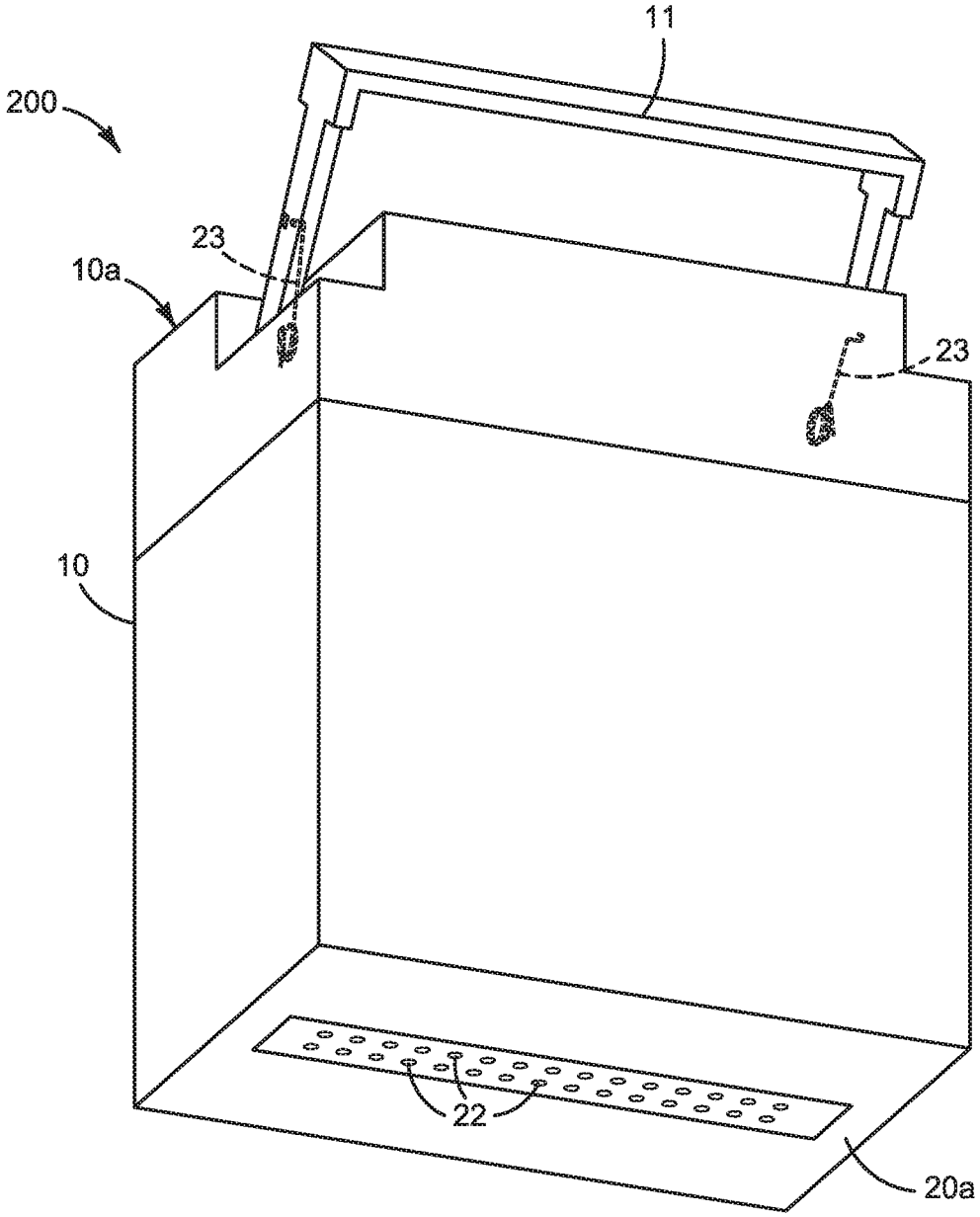
FIG. 2 is a perspective view illustrating a printhead according to an example.

FIG. 2 is a perspective view illustrating a printhead according to an example. The printhead 200 may include the printhead housing 10 and the handle 11 as previously discussed with respect to the printhead 100 of FIG. 1. Referring to FIG. 2, in some examples, the printhead housing 10 may include a removable printhead cartridge. For example, the removable printhead cartridge may be an inkjet printhead such as a thermal inkjet printhead, a piezoelectric inkjet printhead, and the like. The removable printhead cartridge may include a nozzle surface 20*a* on one end and the respective housing surface 10*a* on another end thereof.

Referring to FIG. 2, in some examples, the nozzle surface 20*a* may include a plurality of nozzles 22, for example, in which printing fluid may be ejected there through and out of the removable printhead cartridge. The printhead housing 10 may be inserted into and removed from a printer. In some examples, a plurality of printheads 200 may be inserted into and removed from a recessed compartment 47 of the printer, and the like. The printhead 200 may also include a resilient member 23. For example, the resilient member 23 may include a spring. In some examples, the printhead 200 may include a plurality of resilient members 23.

Figure 3A:
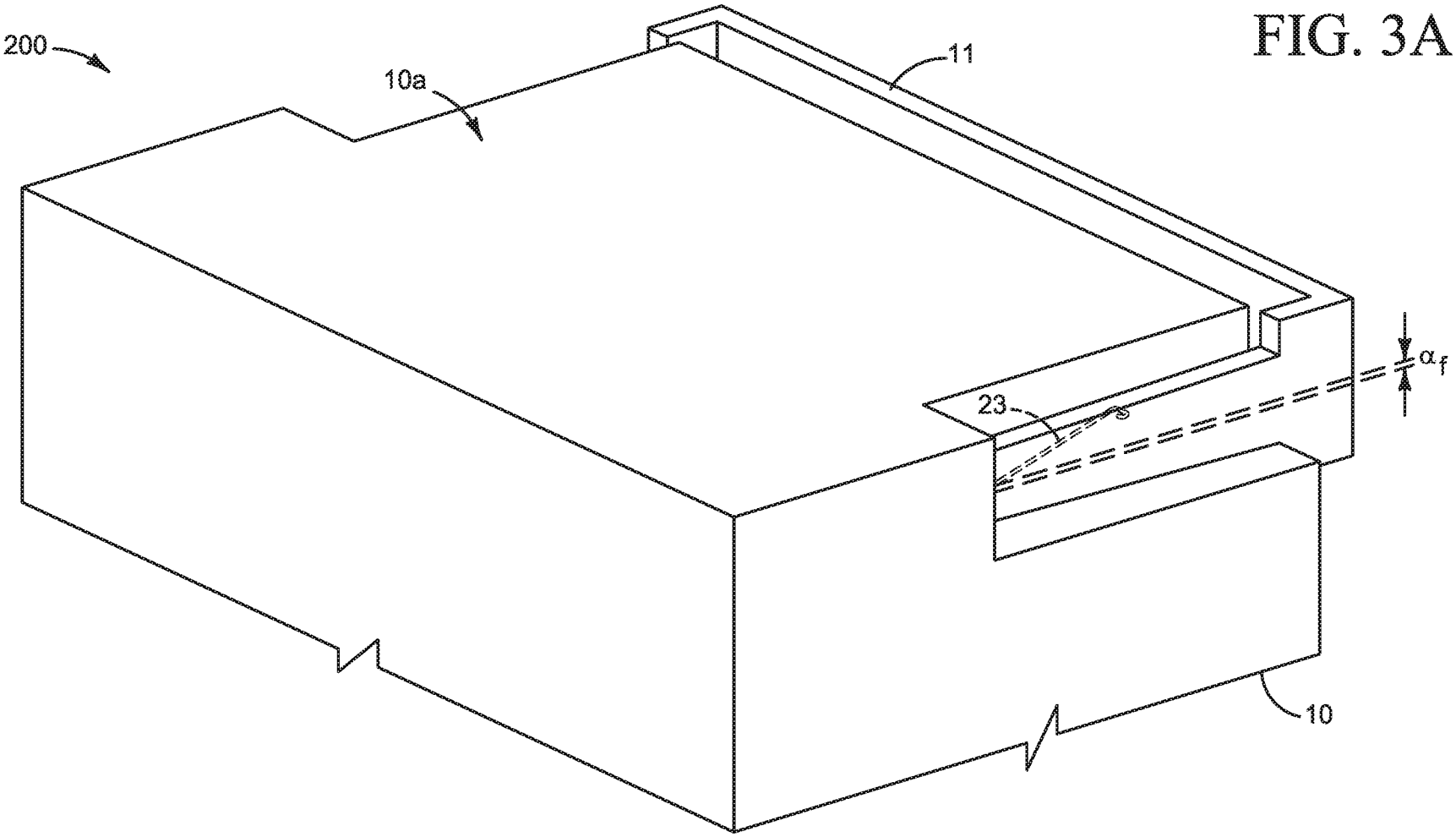
FIGS. 3A and 3B are perspective views illustrating a handle of a printhead in a folded position and a non-folded position, respectively, according to examples.
Figure 3B:
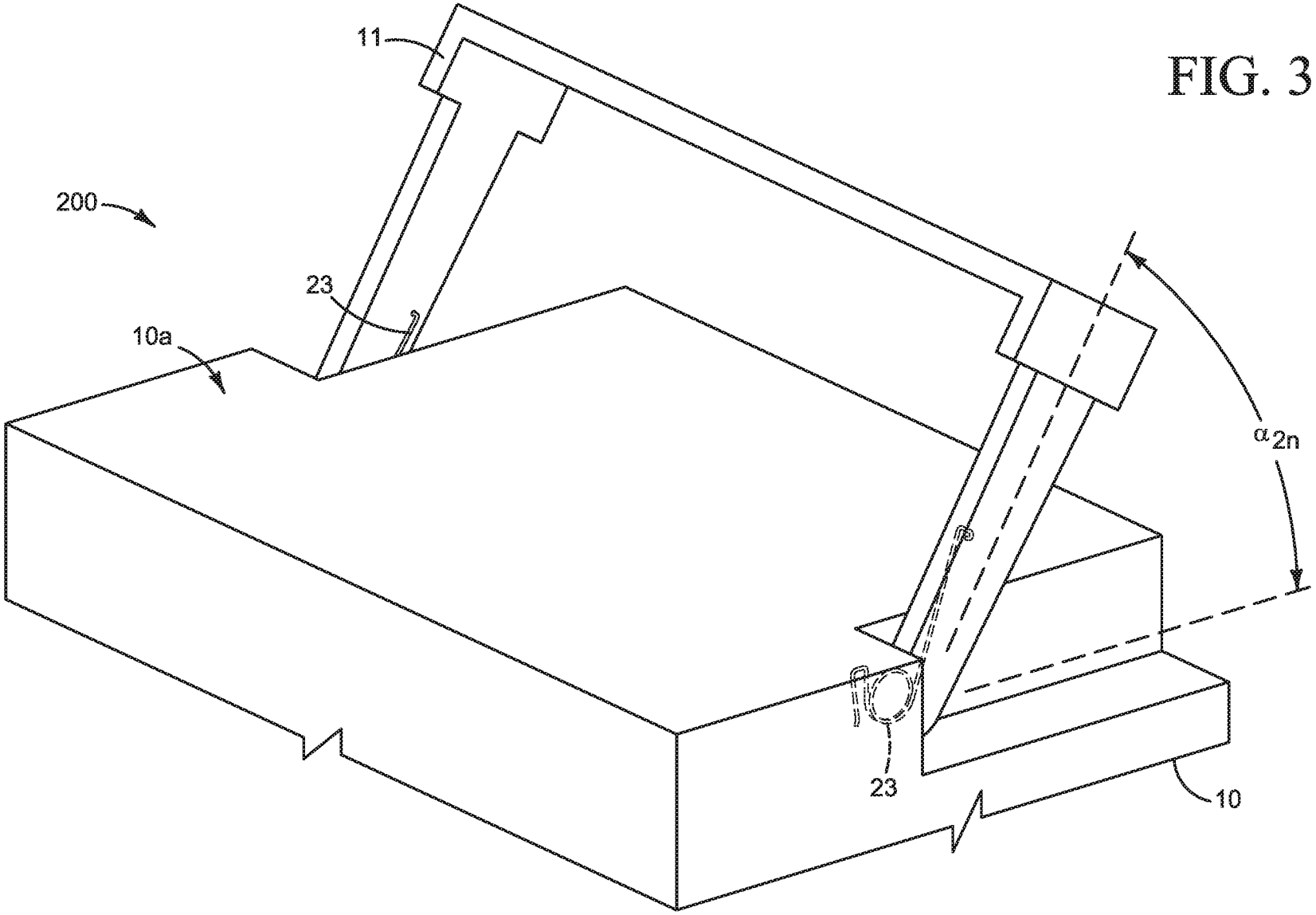

FIGS. 3A and 3B are perspective views illustrating a handle of a printhead in a folded position and a non-folded position, respectively, according to examples. Referring to FIG. 3A, in the folded position 11*a*, a folded angle $\alpha_f$ formed by the handle 11 and the respective housing surface 10*a* of the printhead housing 10 may be about zero degrees as illustrated in FIG. 3A. In some examples, the handle 11 may be substantially parallel to the respective housing surface 10*a*. For example, the respective printhead surface 10*a* may be a top or bottom surface of the printhead housing 10. In some examples, the handle 11 may not extend above the respective housing surface 10*a*. In the folded position 11*a*, the printhead 200 including the handle 11 may be positioned such that the printhead 200 may not be inadvertently removed from the printer.

Referring to FIG. 3B, in some examples, the resilient member 23 may provide a force to bias the handle 11 to the non-folded position 11*b*. For example, the non-folded position 11*b* includes the handle 11 extending outward from the respective housing surface 10*a* of the printhead housing 10 and forming a non-folded angle $\alpha_n$ with the respective housing surface 10*a* as illustrated in FIG. 3B. Thus, in a non-folded position 11*b*, the handle 11 may be accessed by a user to remove the printhead 200 from the printer. Also, in a non-folded position 11*b*, the handle 11 may be accessed by a user to insert the printhead 200 into the printer. In some examples, the non-folded angle $\alpha_n$ may be in a range of 25 to 75 degrees.

Figure 4:
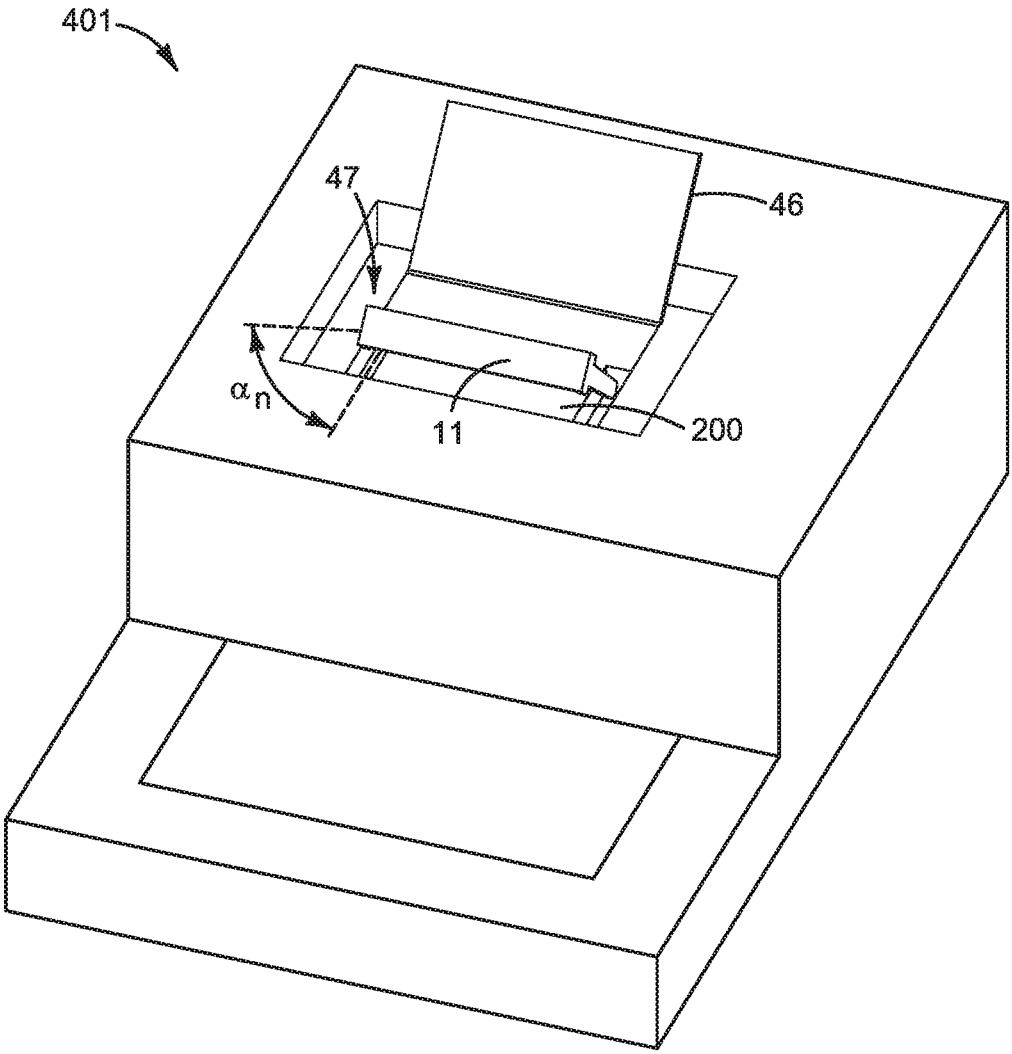
FIG. 4 is a schematic view of the printhead of FIG. 2 inserted in a printer according to an example.

FIG. 4 is a schematic view illustrating the printhead of FIG. 2 inserted in a printer according to an example. Referring to FIG. 4, a printer 401 may include a recessed compartment 47, a cover member 46, and a printhead 200 removably inserted into a recessed compartment 47 of the printer 401. In some examples, a plurality of printheads 200 may be removably inserted into the recessed compartment 47. The cover member 46 may rotatably move to cover and uncover the printhead 200 inserted into the recessed compartment 47. For example, the cover member 46 may push the handle 11 to the folded position 11*a* when covering the printhead 200. Thus, in the folded position 11*a*, the printhead 200 including the handle 11 may not be inadvertently removed from the printer 401. Also, in the folded position 11*a*, an area needed to contain the printhead 200 may be reduced.

Referring to FIG. 4, in the non-folded position 11*b*, the handle 11 is configured to be accessed by a user to removably move the printhead housing 10 into and out of a printer. The handle 11 may also provide tactile feedback to the user. In some examples, the handle 11 may be U-shaped. Additionally, when the cover member 46 is moved away from and no longer covering the printhead 200, the handle 11 is automatically moved to the non-folded position 11*b*. In the non-folded position 11*b*, the handle 11 may be easily access by the user to remove the printhead 200 from the recessed compartment 47 of the printer 401.

Figure 5:
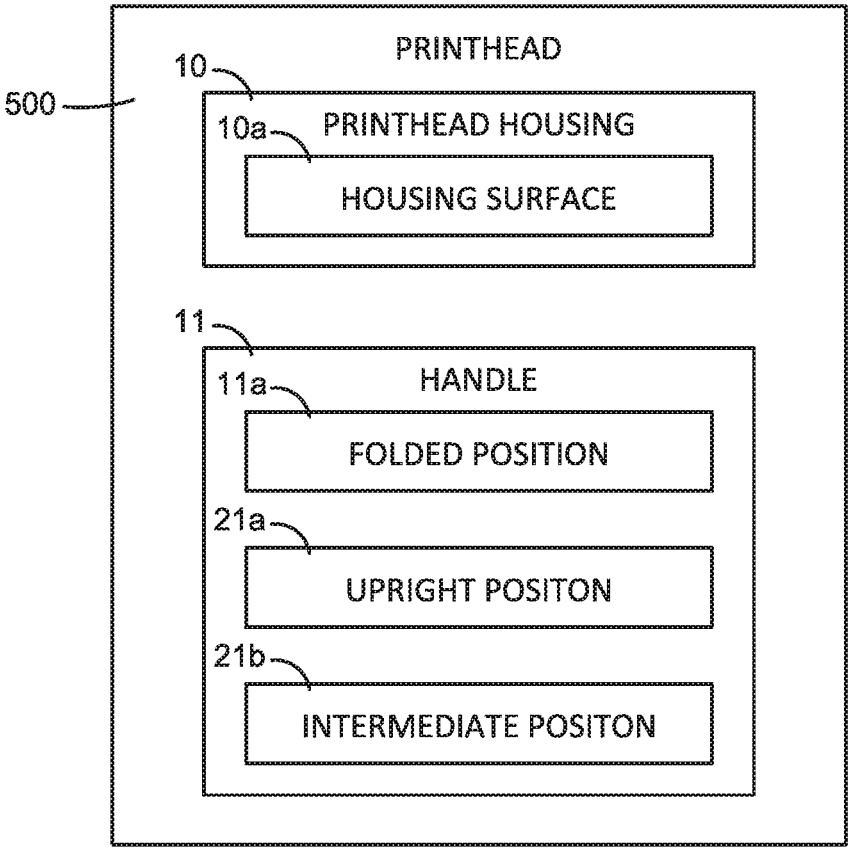
FIG. 5 is a block diagram illustrating a printhead according to an example.
Figure 6A:
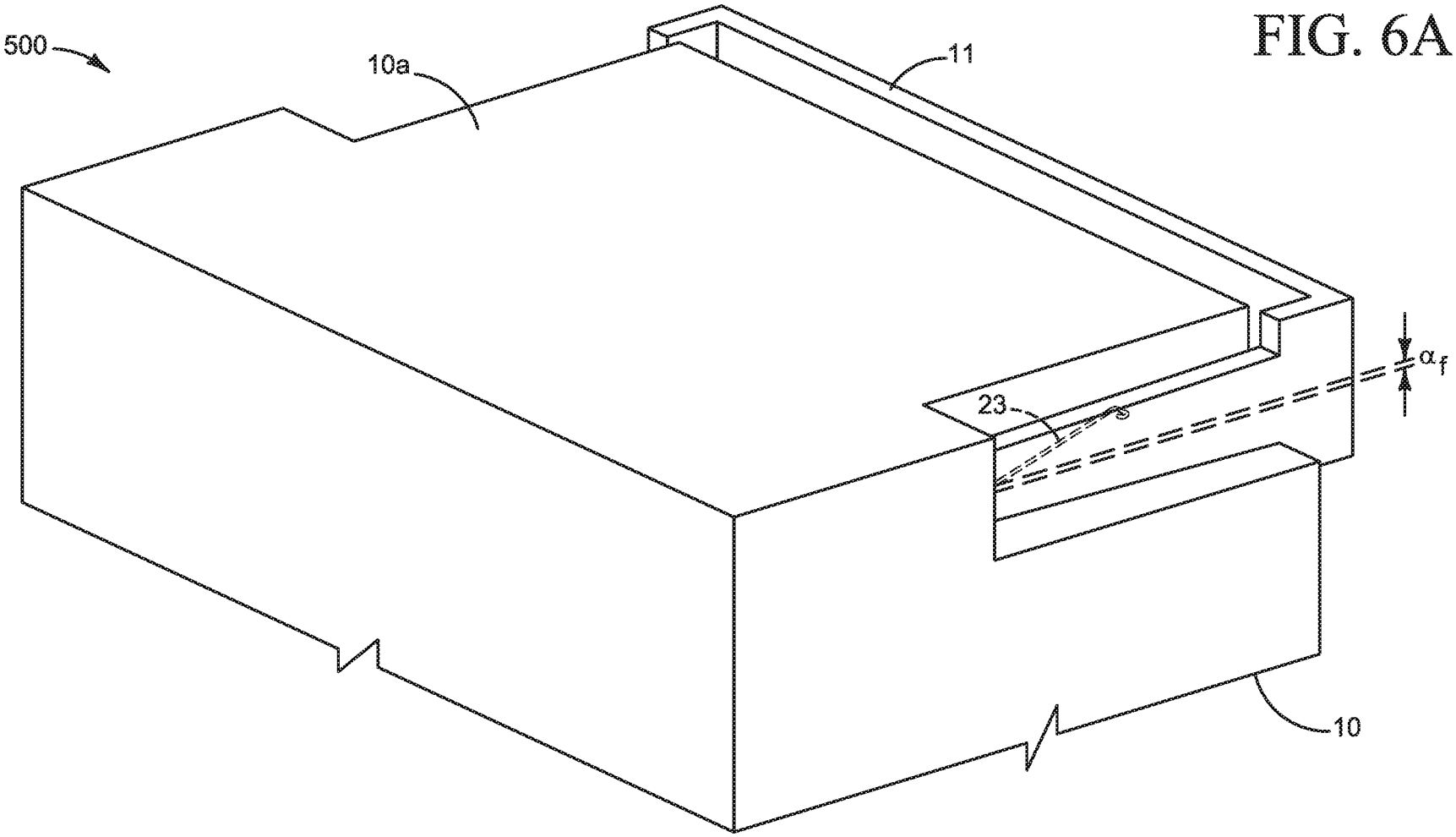
FIGS. 6A, 6B, and 6C are perspective views illustrating the printhead of FIG. 5 in various positions according to examples.
Figure 6B:
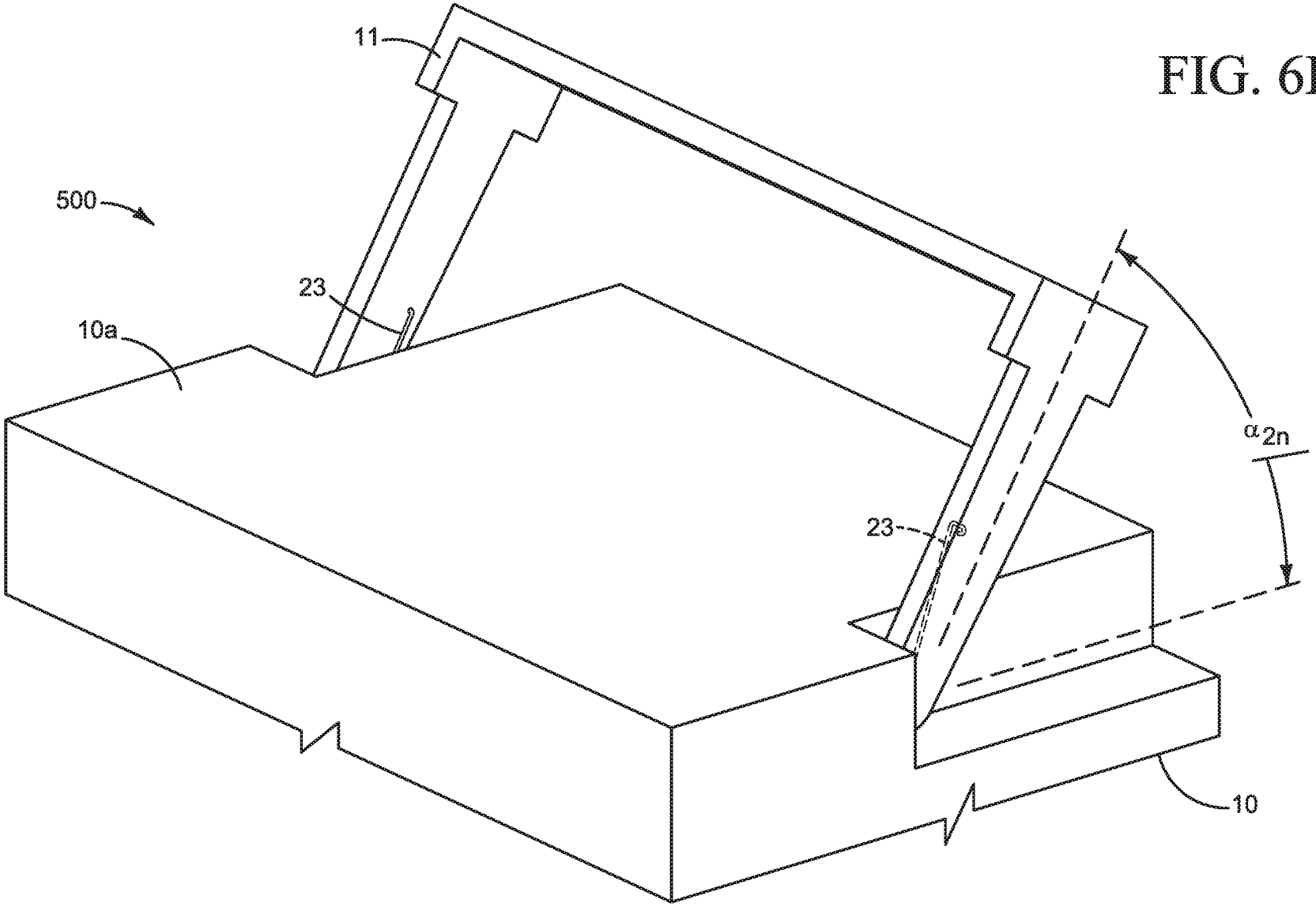
Figure 6C:
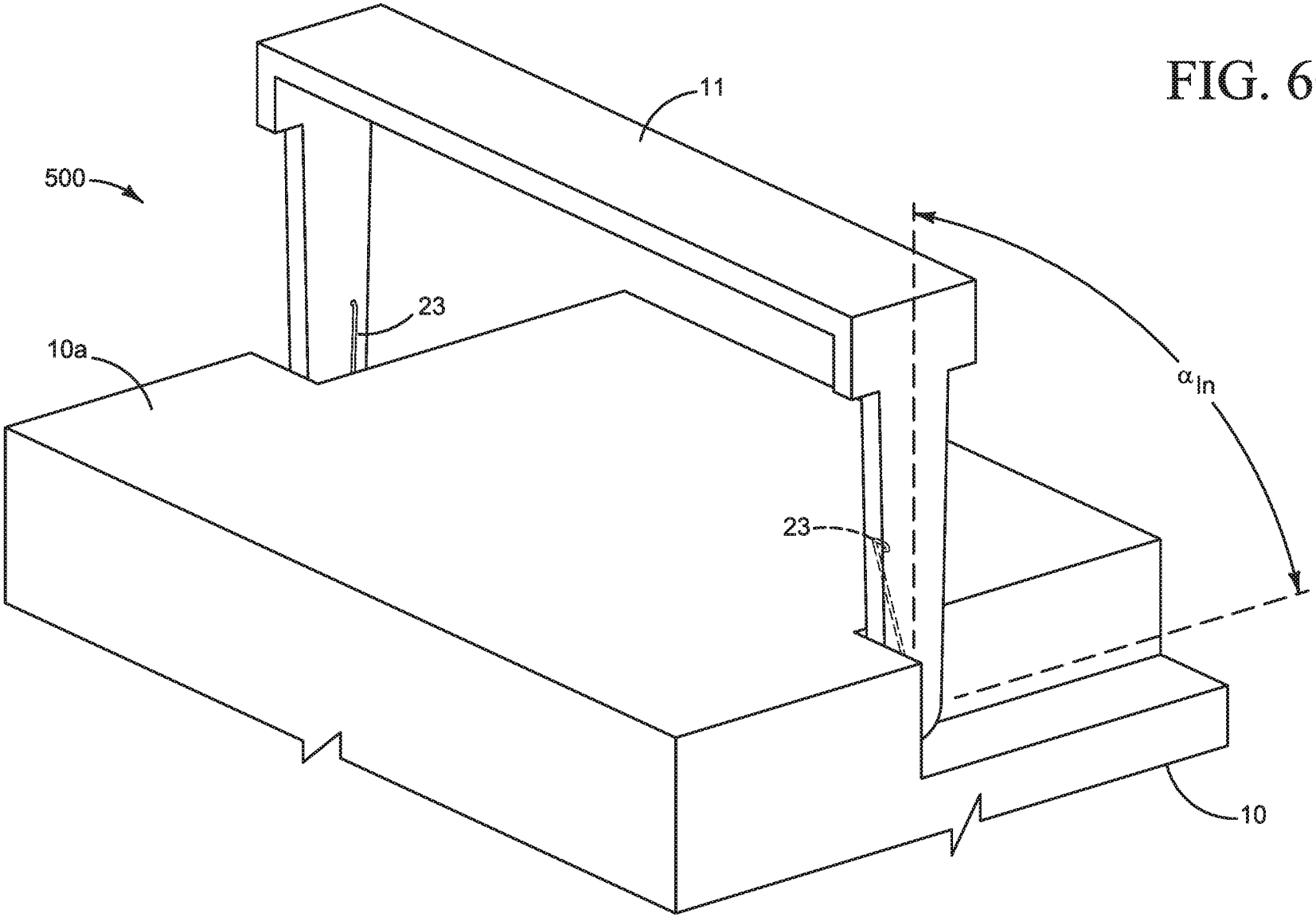

FIG. 5 is a block diagram illustrating a printhead according to an example. FIGS. 6A, 6B, and 6C are perspective views illustrating the printhead of FIG. 5 in various positions according to examples. Referring to FIGS. 5-6C, in some examples, a printhead 500 includes a printhead housing 10 and a handle 11. The printhead housing 10 includes a removable printhead cartridge to be removably inserted into a printer by a user. The handle 11 is movably coupled to the printhead housing 10. The handle 11 rotatably moves with respect to the printhead housing 10 between a folded position 11*a* (FIG. 6A), an intermediate position 21*b* (FIG. 6B), and an upright position 21*a* (FIG. 6C).

The folded position 11*a* corresponds to the handle 11 extending along a respective housing surface 10*a* of the printhead housing 10 as illustrated in FIG. 6A. For example, a folded angle $\alpha_f$ formed by the handle 11 and the respective housing surface 10*a* of the printhead housing 10 in a folded position 11*a* is about zero degrees. In some examples, the second non-folded angle $\alpha_{2n}$ is in a range of 25 to 75 degrees. The upright position 21*a* corresponds to the handle 11 extending outward from the respective housing surface 10*a* of the printhead housing 10 and forming a first non-folded angle $\alpha_{1n}$ with the respective housing surface 10*a* as illustrated in FIG. 6C. For example, in response to a user grabbing the handle 11, a weight of the printhead 500 may fully extend the handle 11 to a fully upright orientation and provide tactile feedback to the user. In some examples, the first non-folded angle $\alpha_{1n}$ is about 90 degrees. The intermediate position 21*b* corresponds to the handle 11 extending outward from the respective housing surface 10*a* of the printhead housing 10 and forming a second non-folded angle $\alpha_{2n}$ with the respective housing surface 10*a* less than the first non-folded angle $\alpha_{1n}$ as illustrated in FIG. 6B. For example, the handle 11 may be biased at the second non-folded angle $\alpha_{2n}$ to allow sufficient access for a user to grab.

Figure 7:
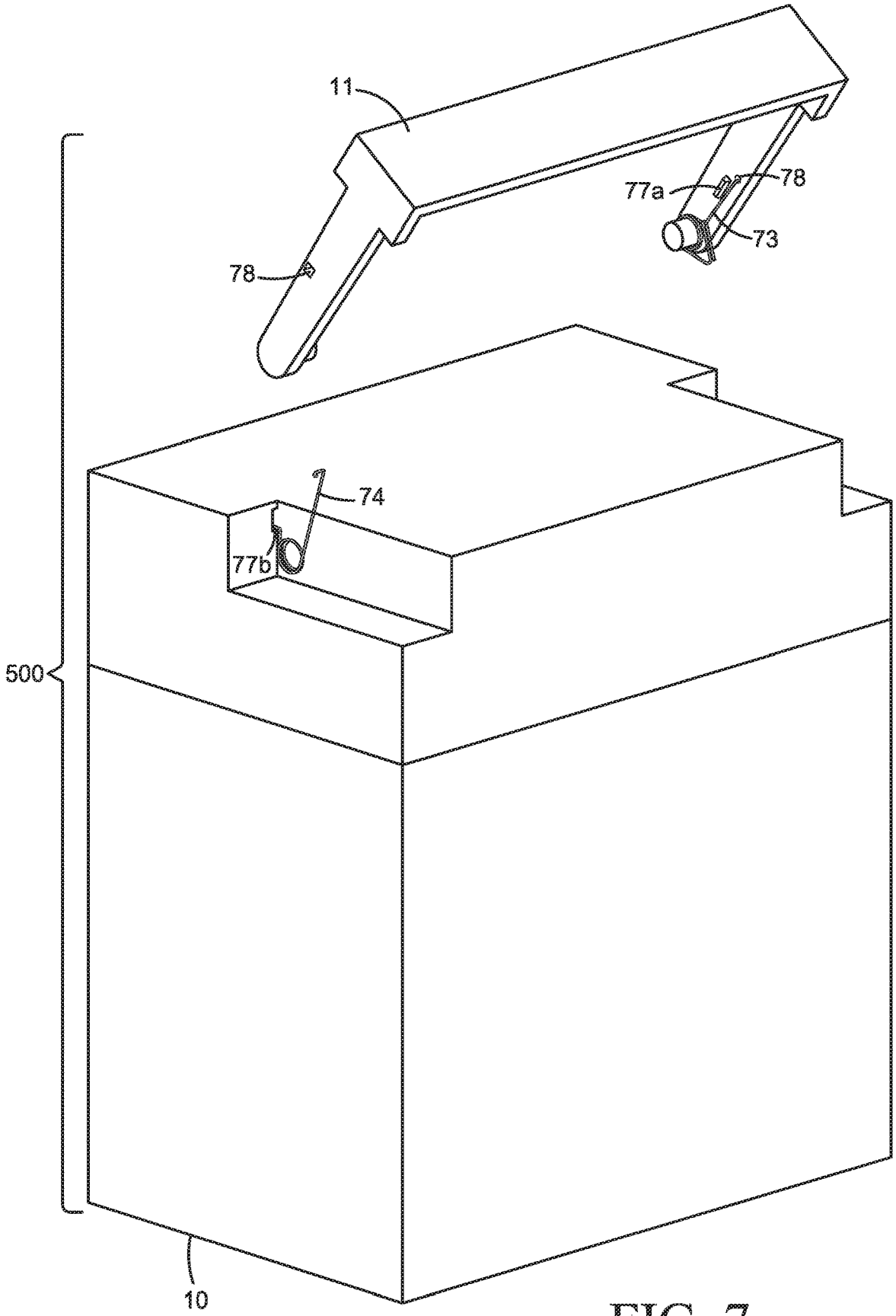
FIG. 7 is a schematic view illustrating the printhead of FIG. 5 in a disassembled state according to an example.
Figure 8B:
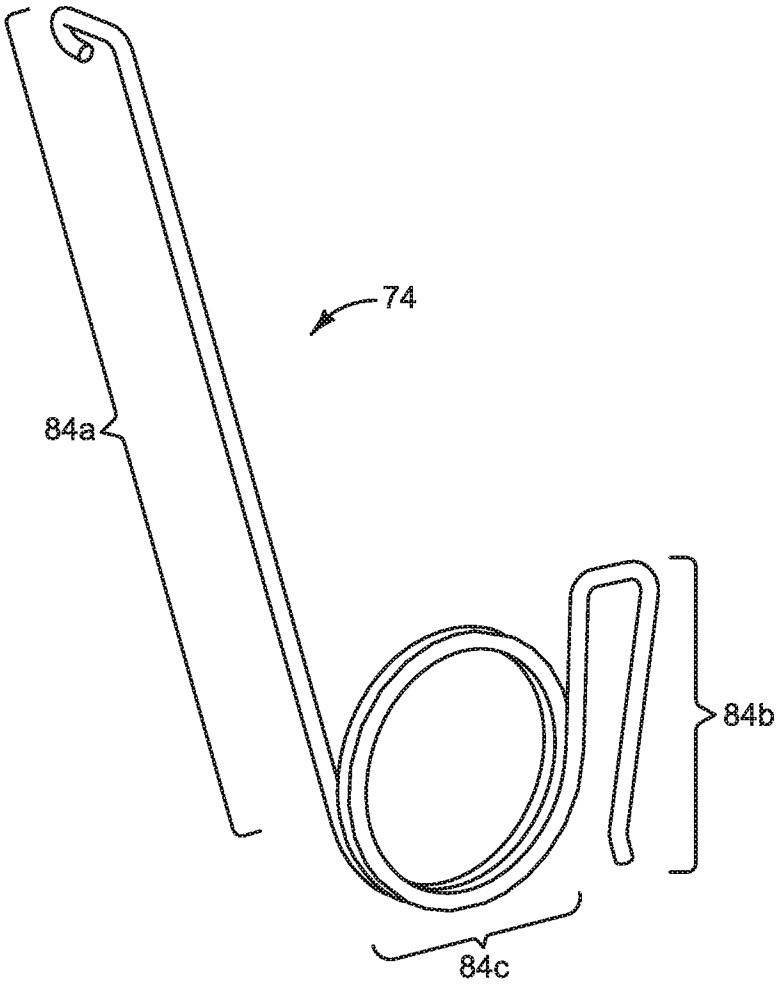
FIGS. 8A and 8B are schematic views illustrating a lift spring and a return spring, respectively, of the printhead of FIG. 5 according to examples.
Figure 8A:
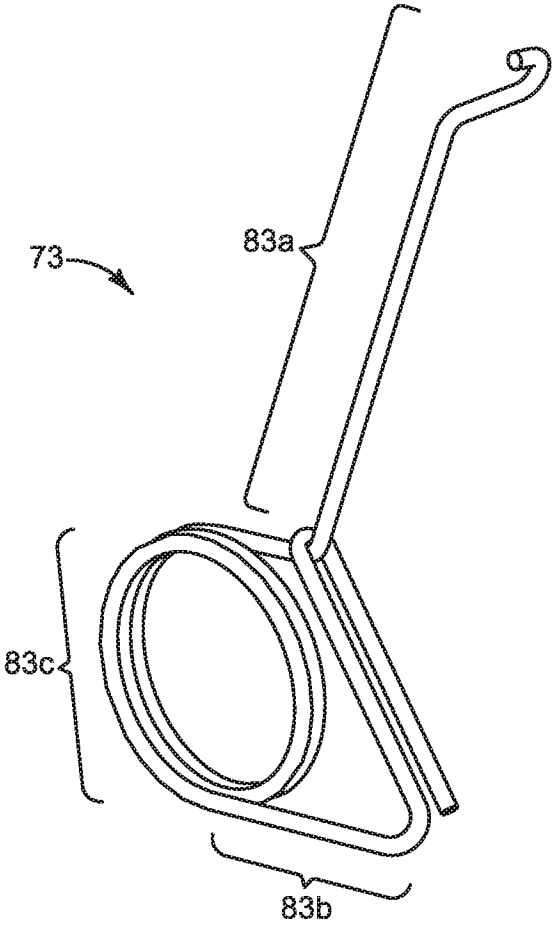

FIG. 7 is a schematic view of the printhead of FIG. 5 in a disassembled state according to an example. FIGS. 8A and 8B are schematic views illustrating a lift spring and a return spring, respectively, of the printhead of FIG. 5 according to examples. Referring to FIGS. 7-8B, in some examples, the printhead 500 also includes a lift spring 73 and a return spring 74. The lift spring 73 lifts the handle 11 from the folded position 11*a* (FIG. 6A) to the intermediate position 21*b* (FIG. 6B). The return spring 74 pushes the handle 11 from the upright position 21*a* (FIG. 60) to the intermediate position 21*b*. The lift spring 73 and the return spring 74 provide a force to bias the handle 11 to the intermediate position 21*b* to be accessed by the user to remove the removable cartridge from the printer. The handle 11 and the printhead housing 10 may include protrusions 77*a* and 77*b* such as ribs, and holes 78 to engage portions of the lift spring 73 and the return spring 74.

Referring to FIGS. 7 and 8A, in some examples, the lift spring 73 may include a first lift leg portion 83*a*, a second lift leg portion 83*b*, and a lift intermediate portion 83*c*. In the assembled state, the first lift leg portion 83*a* contacts the handle 11. The second lift leg portion 83*b* contacts the printer. The lift intermediate portion 83*c* contacts the handle 11 and is disposed between the first lift leg portion 83*a* and the second lift leg portion 83*b*. The lift spring 73 lifts the handle 11 from the folded position 11*a* to the intermediate position 21*b*. That is, absent an overriding force, the lift spring 73 automatically lifts the handle 11 from the folded position 11*a* to the intermediate position 21*b*. For example, the handle 11 may be raised from the folded position 11*a* to the unfolded position 11*b* by the first lift leg portion 83*a* sliding in the second lift leg portion 83*b* such as a U-shaped slot.

Referring to FIGS. 7 and 8B, in some examples, the return spring 74 may include a first return leg portion 84*a*, a second return leg portion 84*b*, and a return intermediate portion 84*c*. In the assembled state, the first return leg portion 84*a* contacts the handle 11. The second return leg portion 84*b* contacts a printer. The return intermediate portion 84*c* contacts the handle 11 and is disposed between the first return leg portion 84*a* and the second return leg portion 84*b*. The return spring 74 pushes the handle 11 from the upright position 21*a* to the intermediate position 21*b*. That is, absent an overriding force, the return spring automatically pushes the handle 11 from the upright position 21*a* to the intermediate position 21*b*.

The present disclosure has been described using non-limiting detailed descriptions of examples thereof that are not intended to limit the scope of the general inventive concept. It should be understood that features and/or operations described with respect to one example may be used with other examples and that not all examples have all of the features and/or operations illustrated in a particular figure or described with respect to one of the examples. Variations of examples described will occur to persons of the art. Furthermore, the terms "comprise," "include," "have" and their conjugates, shall mean, when used in the disclosure and/or claims, "including but not necessarily limited to."

It is noted that some of the above described examples may include structure, acts or details of structures and acts that may not be essential to the general inventive concept and which are described for illustrative purposes. Structure and acts described herein are replaceable by equivalents, which perform the same function, even if the structure or acts are different, as known in the art. Therefore, the scope of the general inventive concept is limited only by the elements and limitations as used in the claims.

What is claimed is:

1. A printhead assembly comprising:

a housing;

a printhead coupled with the housing, the printhead having a nozzle surface; and a handle movably coupled to the housing, the handle to rotatably move with respect to the housing between a folded position in which the handle extends along a respective housing surface of the housing and a non-folded position in which the handle extends outward from the respective housing surface of the housing; and a plurality of resilient members that bias the handle in two opposing directions to an intermediate position between the folded position and an upright position.

2. The printhead assembly of claim 1, wherein a folded angle formed by the handle and the respective housing surface of the housing in a folded position is about zero degrees.

3. The printhead assembly of claim 1, wherein a non-folded angle formed by the handle and the respective housing surface of the housing in the non-folded position is in a range of 25 degrees to 75 degrees.

4. The printhead assembly of claim 1, wherein the plurality of resilient members comprises both a lift spring to provide a force to bias the handle away from the folded position to the non-folded position and a return spring to provide a force to bias the handle away from the upright position to the intermediate position.

5. The printhead assembly of claim 1, wherein the handle is accessible by a user to removably move the housing, the housing being moved with the handle attached thereto, into and out of a printer when the handle is in the non-folded position.

6. The printhead assembly of claim 1, wherein the printhead comprising a printhead cartridge that is removably coupled with the housing.

7. The printhead assembly of claim 1, wherein the plurality of resilient members comprise:

a lift spring to bias the handle away from the folded position toward the intermediate position; and a return spring, opposing the lift spring, to bias the handle from the upright position toward the intermediate position.

8. The printhead assembly of claim 7, wherein:

the return spring comprises a first return leg portion to contact the handle;

a second return leg portion, having a U-shape, to contact a printer, and a return intermediate portion to contact the handle disposed between the first return leg portion and the second return leg portion; and the lift spring comprises a first lift leg portion to contact the handle;

a second lift leg portion to contact the printer; and a lift intermediate portion to contact the handle disposed between the first lift leg portion and the second lift leg portion, wherein the second lift leg portion wraps around a portion of the first lift leg adjacent the lift intermediate portion.

9. The printhead assembly of claim 1, wherein a weight of the printhead assembly causes the handle, when pulled by a user, to extend to the upright position to provide tactile feedback to the user.

10. A printhead assembly installed in a printer comprising:

the printhead assembly comprising a housing and a removable printhead cartridge installed on the housing, the printhead cartridge comprising a nozzle surface, the printhead assembly being removably installed in the printer;

the printhead assembly further comprising a handle movably coupled to the housing, the handle to rotatably move with respect to the housing between an upright position, an intermediate position, and a folded position, wherein:

the folded position corresponds to the handle extending along a respective housing surface of the housing;

the upright position corresponds to the handle extending outward from the respective housing surface of the housing and forming a first non-folded angle with the respective housing surface; and the intermediate position corresponds to the handle extending outward from the respective housing surface of the housing and forming a second non-folded angle with the respective housing surface less than the first non-folded angle;

the printhead assembly further comprising a resilient member to bias the handle away from the folded position, wherein the resilient member comprises a lift spring to lift the handle from the folded position to the intermediate position, biasing the handle to the intermediate position; and the printer comprising a cover that, when closed, forces the handle into the folded position against the bias;

wherein the handle in a non-folded position is configured to be accessed by a user to removably move the printhead housing into and out of a printer.

11. The printhead assembly of claim 10, wherein the first non-folded angle is about 90 degrees.

12. The printhead assembly of claim 10, wherein the second non-folded angle is in a range of 25 to 75 degrees.

13. The printhead assembly of claim 10, wherein a folded angle formed by the handle and the respective housing surface of the housing in a folded position is about zero degrees.

14. The printhead assembly of claim 10, wherein the lift spring comprises:

a first lift leg portion to contact the handle;

a second lift leg portion to contact the printer; and a lift intermediate portion to contact the handle disposed between the first lift leg portion and the second lift leg portion.

15. The printhead assembly of claim 10, wherein the resilient member further comprises a return spring to push the handle from the upright position to the intermediate position.

16. The printhead assembly of claim 15, wherein the return spring comprises:

a first return leg portion to contact the handle;

a second return leg portion, and a return intermediate portion to contact the handle disposed between the first return leg portion and the second return leg portion.

17. The printhead assembly of claim 10, further comprising: a lift spring and a return spring to provide opposing forces to bias the handle to the intermediate position to be accessed by the user to remove the removable cartridge from the printer.

18. The printhead assembly of claim 10, wherein the resilient member biases the handle in two opposing directions to the intermediate position between the folded position and the upright position.

19. The printhead assembly of claim 10, wherein a weight of the printhead assembly causes the handle, when pulled by a user, to extend to the upright position to provide tactile feedback to the user.

* * * * *